US009316127B2

(12) United States Patent
Elfers

(10) Patent No.: US 9,316,127 B2
(45) Date of Patent: Apr. 19, 2016

(54) ADJUSTABLE CAMSHAFT DRIVE

(71) Applicant: VOLKSWAGEN AKTIENGESELLSCHAFT, Wolfsburg (DE)

(72) Inventor: Uwe Elfers, Lehre (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 0 days.

(21) Appl. No.: 14/296,656

(22) Filed: Jun. 5, 2014

(65) Prior Publication Data

US 2014/0283773 A1 Sep. 25, 2014

Related U.S. Application Data

(63) Continuation of application No. PCT/EP2012/074814, filed on Dec. 7, 2012.

(30) Foreign Application Priority Data

Dec. 10, 2011 (DE) ..... 10 2011 120 815

(51) Int. Cl.
*F01L 1/34* (2006.01)
*F01L 1/344* (2006.01)
(Continued)

(52) U.S. Cl.
CPC ..... *F01L 1/344* (2013.01); *F01L 1/026* (2013.01); *F01L 1/3442* (2013.01); *F01L 2001/0473* (2013.01); *F01L 2001/0537* (2013.01)

(58) Field of Classification Search
CPC . F01L 1/344; F01L 1/053; F01L 2001/34476; F01L 2001/34473; F01L 2001/34469; F01L 2001/34466; F01L 2001/34463; F01L 2001/34459; F01L 2001/34456; F01L 2001/34453; F01L 2001/3445; F01L 1/3442; F01L 2001/34486; F01L 2001/34489; F01L 2001/34493; F01L 2001/34496; F01L 2001/0475; F01L 2001/0473
See application file for complete search history.

(56) References Cited

U.S. PATENT DOCUMENTS 4,535,733 A 8/1985 Honda
5,275,138 A 1/1994 Hotta et al.
(Continued)

FOREIGN PATENT DOCUMENTS

DE 3217203 C2 12/1982
DE 4036010 A1 5/1992
(Continued)

OTHER PUBLICATIONS

D. L. Boggs, H. S. Hilbert, M. M. Schechter, "The Otto-Atkinson Cycle Engine-Fuel Economy and Emissions Results and Hardware Design", SAE Technical Paper Series, Society of Automotive Engineers, Warrendale, PA, US, Jan. 1, 1995, pp. 220-232, XP008006455, ISSN: 0148-7191 (p. 11, col. 2, paragraph 2—p. 12, col. 1, paragraph 1).
(Continued)

*Primary Examiner* — Thomas Denion
*Assistant Examiner* — Daniel Bernstein
(74) *Attorney, Agent, or Firm* — Manfred Beck, P.A.

(57) ABSTRACT

A camshaft drive includes a drive shaft having at least one cam for actuating a valve of an internal combustion engine. A shaft-in-shaft system is disposed parallel to the drive shaft and has an inner shaft and an outer shaft each having at least one cam for actuating a valve. The outer shaft is connected to an outer shaft transmission element in a manner fixed against relative rotation. A hydraulic transmission device includes a stator, a rotor, and an intermediate member. The inner shaft is coupled to the drive shaft via the hydraulic transmission device which is operatively connected to an adjusting device and to a control device for setting a desired phase angle between the inner shaft and the outer shaft. A drive element is coupled to the drive shaft. The drive element is directly coupled both to the outer shaft transmission element and to the stator.

7 Claims, 1 Drawing Sheet

(51) Int. Cl.

| | |
|---|---|
| ***F01L 1/02*** | (2006.01) |
| *F01L 1/047* | (2006.01) |
| *F01L 1/053* | (2006.01) |

(56) References Cited

U.S. PATENT DOCUMENTS

| | | | | |
|---|---|---|---|---|
| 8,235,015 | B2 * | 8/2012 | Murata | 123/90.17 |
| 8,371,257 | B2 * | 2/2013 | Moon et al. | 123/90.17 |
| 2009/0308338 | A1 | 12/2009 | Tashiro | |
| 2009/0314235 | A1 * | 12/2009 | Rozario et al. | 123/90.17 |
| 2010/0089350 | A1 | 4/2010 | Myers | |
| 2010/0186700 | A1 | 7/2010 | Kandolf et al. | |
| 2010/0212619 | A1 * | 8/2010 | Murata | 123/90.17 |
| 2014/0165935 | A1 * | 6/2014 | Gerlingen et al. | 123/90.6 |

FOREIGN PATENT DOCUMENTS

| | | | |
|---|---|---|---|
| DE | 4302561 | A1 | 8/1993 |
| DE | 102009041873 | A1 | 4/2010 |
| EP | 0254058 | A2 | 1/1988 |
| EP | 0640749 | A1 | 3/1995 |
| EP | 640749 | A1 * | 3/1995 |
| EP | 0915234 | A2 | 5/1999 |
| EP | 1505267 | A1 | 2/2005 |
| EP | 2339150 | A2 | 6/2011 |
| JP | 7-224617 | A | 8/1995 |
| WO | 2009/005999 | A1 | 1/2009 |
| WO | 2010/033417 | A2 | 3/2010 |

OTHER PUBLICATIONS

Search Report issued by the German Patent and Trademark Office for German Patent Application No. DE 10 2011 120 815.5, dated Nov. 26, 2012.

International Search Report for International Application No. PCT/EP2012/074814 and translation thereof, dated Feb. 20, 2013.

International Preliminary Report on Patentability for International Application No. PCT/EP2012/074814 and translation thereof, dated Jun. 10, 2014.

* cited by examiner

ADJUSTABLE CAMSHAFT DRIVE

CROSS-REFERENCE TO RELATED APPLICATIONS

This application is a continuation, under 35 U.S.C. §120, of copending International Application No. PCT/EP2012/074814, filed Dec. 7, 2012, which designated the United States; this application also claims the priority, under 35 U.S.C. §119, of German Patent Application No. DE 10 2011 120 815.5, filed Dec. 10, 2011; the prior applications are herewith incorporated by reference in their entirety.

BACKGROUND OF THE INVENTION

Field of the Invention

The invention relates to an adjustable camshaft drive.

German Patent Application No. DE 43 02 561 A1 discloses an adjustable valve controller for an internal combustion engine having two camshafts. In the case of this valve controller, the relative position of a first camshaft with respect to a second camshaft can be changed by an axial displacement of an actuating piston with a helical or spiral toothing via an oil pressure control device from a first position to a second position.

European Patent Application No. EP 2 339 150 A2 discloses an internal combustion engine with a so-called cam-in-cam camshaft, which is intended to deactivate individual cylinders. Devices for a phase adjustment are disposed at the camshafts, the configuration of these devices is not described in detail.

German Patent Application No. DE 40 36 010 A1 discloses an adjustable camshaft drive with a hydraulic actuating system. In the case of this drive, the intake camshaft and the exhaust camshaft can be adjusted via a partially straight toothed and partially helically toothed double gearwheel and gearwheels which engage with it and which are connected to the shafts.

German Patent No. DE 32 17 203 C2 discloses a variable valve controller for an internal combustion engine having two camshafts which are disposed parallel to one another, wherein one of the camshafts has cams for low rotational speeds and the other camshaft has cams for high rotational speeds. The valve controller further includes an adjusting device, through the use of which it can be controlled which of the two camshafts is to be activated.

European Patent Application No. EP 0 254 058 A2 discloses an adjusting device for a camshaft for controlling the intake valves and the exhaust valves with a shaft-in-shaft system. In this system, the cams are arranged partly on an inner shaft and partly on an outer shaft that surrounds the inner shaft. In order to achieve a relative rotation of the inner shaft with respect to the outer shaft, a device with a planetary gear set is provided, via which the inner shaft is connected to the outer shaft.

SUMMARY OF THE INVENTION

It is accordingly an object of the invention to provide a camshaft drive which overcomes disadvantages of the heretofore-known camshaft drives of this general type. In particular, it is an object of the invention to provide a camshaft drive with a shaft-in-shaft system, wherein the camshaft drive is simple in construction and cost-efficient to manufacture. Furthermore, there should only be a small play or slackness between the drive element and the shaft-in-shaft system.

With the foregoing and other objects in view there is provided, in accordance with the invention, in an internal combustion engine having valves, a camshaft drive including:

a drive shaft having at least one cam for actuating one of the valves of the internal combustion engine;

a shaft-in-shaft system disposed parallel to the drive shaft, the shaft-in-shaft system having an inner shaft and an outer shaft, the outer shaft being disposed coaxial to the inner shaft and surrounding the inner shaft;

the inner shaft and the outer shaft each having at least one cam for actuating one of the valves of the internal combustion engine;

an outer shaft transmission element, the outer shaft being coupled to the drive shaft via the outer shaft transmission element, the outer shaft being connected to the outer shaft transmission element in a manner fixed against relative rotation;

a hydraulic transmission device including a stator, a rotor, and an intermediate member disposed between the rotor and the inner shaft, the inner shaft being coupled to the drive shaft via the hydraulic transmission device;

an adjusting device and a control device, the hydraulic transmission device being operatively connected to the adjusting device and to the control device for setting a desired phase angle between the inner shaft and the outer shaft, the control device including at least one device selected from the group including an open loop control device and a dosed loop control device; and a drive element coupled to the drive shaft, the drive element being directly coupled both to the outer shaft transmission element and to the stator.

In other words according to the invention, there is provided a camshaft drive including a drive shaft having at least one cam for actuating a valve of an internal combustion engine, a shaft-in-shaft system disposed parallel to the drive shaft, the shaft-in-shaft system having an inner shaft and an outer shaft disposed coaxial to the inner shaft and surrounding the inner shaft, wherein the inner shaft and the outer shaft include in each case at least one cam for actuating a valve of an internal combustion engine, wherein the outer shaft is coupled to the drive shaft via an outer shaft transmission element, the outer shaft is connected to the outer shaft transmission element in a manner fixed against relative rotation, wherein the inner shaft is coupled to the drive shaft via a hydraulic transmission device including a stator, a rotor and an intermediate member disposed between the rotor and the inner shaft, wherein the hydraulic transmission device is operatively connected to an adjusting device and to a control and/or regulating device, in particular includes the adjusting device as well as the control and/or regulating device, through the use of which a desired phase angle between the inner shaft and outer shaft can be set, and a drive element which is coupled to the drive shaft and which is directly coupled both to the outer shaft transmission element and to the stator.

The camshaft drive according to the invention has the advantage that, with the drive shaft, a direct connection is established both to the outer shaft transmission element as well as to the stator. Thus, a play or clearance caused by any intermediate elements as well as additional production costs and assembly costs for the manufacturing and the installation of intermediate elements are avoided.

According to another feature of the invention, the outer shaft transmission element is an outer shaft gearwheel; the drive element is a drive gearwheel; the outer shaft gearwheel meshes with the drive gearwheel; and the stator has an outer toothing which also meshes with the drive gearwheel. Thus, in a practical embodiment of the camshaft drive according to the invention, the outer shaft transmission element is an outer shaft gearwheel, and the drive element is a drive gearwheel, wherein the outer shaft gearwheel meshes with the drive gearwheel. Furthermore the stator has an outer toothing, which likewise meshes with the drive gearwheel. In addition to the above-mentioned advantage of a direct transmission of the drive torque from the drive element to the outer shaft gearwheel and the stator, gearwheel connections have the advantage that they are very durable and low-maintenance. Further, gearwheel connections have a relatively high efficiency when compared to other transmission elements.

According to a further feature of the invention, the outer shaft gearwheel and the stator each have a respective outer diameter, wherein the outer diameter of the outer shaft gearwheel is equal to the outer diameter of the stator; and the outer shaft gearwheel has a toothing that is the same as the outer toothing of the stator. Thus, if the outer shaft gearwheel has the same outer diameter and the same toothing as the outer toothing of the stator, a simple gearwheel can be used as a drive gearwheel for driving both of the two above-mentioned elements.

Depending on the installation space situation or given general requirements or limiting factors, it is also possible to select only the same outer diameter and different toothings or different outer diameters and the same toothing.

According to another feature of the invention, the outer shaft gearwheel directly adjoins the outer toothing of the stator. Preferably, the outer shaft gearwheel directly adjoins the outer toothing of the stator, without the two elements touching one another. In this case, the width of the drive gearwheel, that is required for driving the above-mentioned elements, is minimized.

According to a further feature of the invention, a first plurality of the valves of the internal combustion engine are exhaust valves and a second plurality of the valves of the internal combustion engine are intake valves; the at least one cam of the drive shaft is a first plurality of cams provided for controlling the exhaust valves; and the at least one cam of the outer shaft and the at least one cam of the inner shaft are a second plurality of cams provided for controlling the intake valves. Thus, in a further practical embodiment, the cams disposed on the drive shaft are provided for the control of exhaust valves and the cams disposed on the outer shaft and on the inner shaft are provided for the control of intake valves. In this case the phase shift between the intake cams disposed on the outer shaft and the exhaust cams disposed on the drive shaft is predetermined, whereas the phase shift between the intake cams disposed on the outer shaft with respect to the intake cams disposed on the inner shaft is adjustable with the help of the adjusting device.

According to another feature of the invention, the stator is formed of several individual elements. Thus, the stator of a camshaft drive according to the invention is preferably formed from several individual elements, such as the stator drive element, the stator housing, and the stator cover, which are furthermore preferably connected to one another through the use of a screwed connection or by a material bond. As a result, a relatively complex geometry with a low total weight can be manufactured while having at the same time the lowest possible production expenditure.

According to another feature of the invention, the inner shaft is a hollow shaft and the intermediate member is a central screw; the central screw has at least one fluid channel; and the rotor and the stator form a chamber, the at least one fluid channel leads from the hollow shaft to the chamber formed by the rotor and the stator, wherein the hollow shaft and the central screw together with the rotor and the stator form a hydraulic oscillating motor. In other words, in a further practical embodiment, the inner shaft is a hollow shaft and the intermediate member is a central screw. The central screw includes at least one fluid channel leading from the hollow shaft to a chamber formed by the rotor and the stator. In order to adjust the phase angle between the inner shaft and the outer shaft, the hollow shaft and the central screw together with the rotor and stator form a hydraulic oscillating motor. In the case of hydraulic oscillating motors preferably at least two different chambers between a rotor and a stator can be pressurized with a fluid pressure, in order to be able to actively generate two different rotational motions.

According to yet another feature of the invention, the inner shaft and the outer shaft have channels for introducing pressure oil from outside into the inner shaft. Preferably, the inner shaft and the outer shaft include channels in order to introduce pressure oil from a region outside the two shafts, through the outer shaft and the inner shaft, into the inner shaft and in order to be able to guide it through the latter. In this case, the housing and in particular a bearing region of a housing can be used to guide oil first into the inner shaft and from there via the central screw into the chambers located in between the stator and the rotor.

Other features which are considered as characteristic for the invention are set forth in the appended claims.

Although the invention is illustrated and described herein as embodied in an adjustable camshaft drive, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 2:
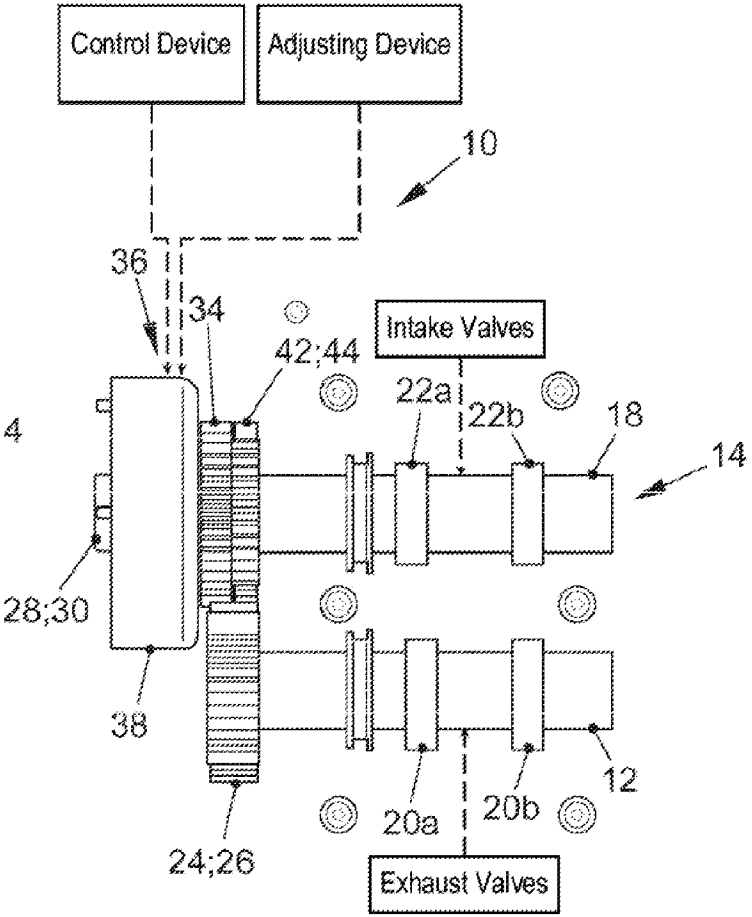
FIG. 2 is a diagrammatic side view of the embodiment of the camshaft drive according to the invention shown in FIG. 1.

Referring now to the figures of the drawings in detail, there is shown, in an internal combustion engine, an embodiment of a camshaft drive 10 according to the invention with a drive shaft 12 embodied as a hollow shaft as well as a shaft-in-shaft system 14 disposed parallel to the drive shaft 12, which are mounted in a housing 15. The shaft-in-shaft system 14 includes an inner shaft 16, which is also embodied as a hollow shaft, as well as a coaxially disposed outer shaft 18, which surrounds the inner shaft 16.

Two exhaust cams 20*a*, 20*b* are disposed on the drive shaft 12 for co-rotation, i.e. fixed against relative rotation with respect to the drive shaft 12. Further, a drive gearwheel 26 is disposed as a drive element 24 on the drive shaft in a manner that is fixed against relative rotation.

Figure 1:
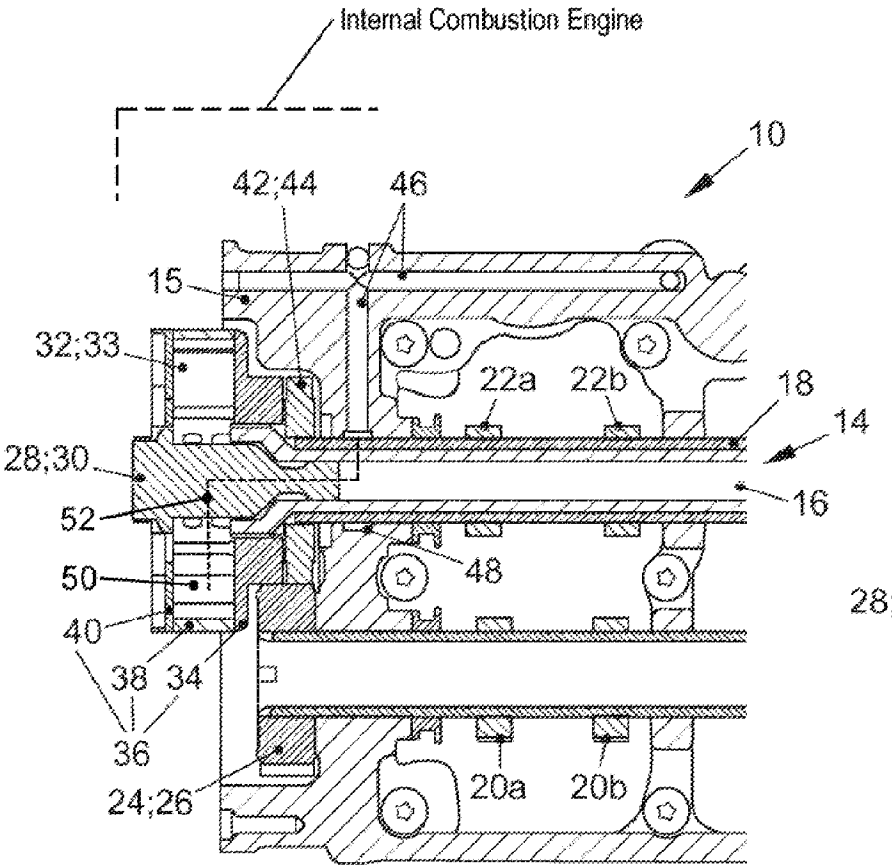
FIG. 1 is a diagrammatic sectional view of an embodiment of a camshaft drive according to the invention.

A first intake cam 22*a* is disposed on the inner shaft 16 in a manner fixed against relative rotation. As can be seen in FIG. 1, the inner shaft 16 protrudes on the left side from the outer shaft 18. The diameter of the inner shaft 15 is enlarged in its protruding region. A central screw 30 is disposed as an intermediate member 28 in the left open end of the inner shaft 16 with the enlarged diameter. It has an external thread at its right end, through the use of which the central screw 30 is connected to the inner shaft 16 in a force-locking manner via an internal thread formed in the inner shaft 16. The central screw 30 further serves to secure a rotor 33 in a force-locking manner relative to the inner shaft 16, wherein the rotor 33 is embodied as a vane wheel 32.

The region of the inner shaft 16 having the enlarged diameter also serves to rotatably support a stator drive element 34 of a stator 36. The stator 36 includes, in addition to the stator drive element 34, a central stator housing 38 and a stator cover 40. The stator drive element 34, the stator housing 38 and the stator cover 40 are connected to one another by screw connections and form a functional unit.

As can be seen in FIG. 2, the stator drive element 34 has a straight outer toothing in the right region having the smaller diameter. A control device, an adjusting device, as well as intake valves and exhaust valves of the internal combustion engine are schematically indicated in FIG. 2.

A second intake cam 22*b* is disposed on the outer shaft 18 in a manner fixed against relative rotation. Furthermore, an outer shaft gearwheel 44 as an outer shaft transmission element is disposed on the outer shaft 18 in a manner fixed against relative rotation.

Since the drive gearwheel 26 meshes directly with the outer shaft gearwheel 44 and with the outer toothing of the stator drive element 34, the drive torque from the drive gearwheel 26 is, on the one hand, transmitted via the outer shaft gearwheel 44, directly to the outer shaft 18. On the other hand, the drive torque is transmitted from the drive gearwheel 26, via the stator drive element 34, to the stator 36, from there, via the medium which is present between the stator 36 and the vane wheel 32, to the vane wheel 32 and from the vane wheel 32, via the central screw 30, to the inner shaft 16. At a constant rotational speed of the drive shaft 12, a steady phase angle between the inner shaft 16 and the outer shaft 18 is therefore reached.

In order to be able to adjust the phase angle between the inner shaft 16 and the outer shaft 18, the relative position between the vane wheel 32 and the stator 36 can be adjusted. For this purpose, boreholes 46 for accommodating a pressurized fluid, in particular oil, are provided in the housing 15. The boreholes 46 lead to an oil distribution groove 48 which surrounds the outer shaft 18 and via which the oil reaches, via slots through the outer shaft 18 and the inner shaft 16, the interior space of the inner shaft 16. From there, there are fluidal connections through the central screw 30 to at least two chambers 50 formed between the vane wheel 32 and the stator 36. The channels are merely schematically indicated by a dashed line 52 in FIG. 1. With the help of flaps and a corresponding open loop control and/or, respectively, closed loop control, a controlled relative movement between the vane wheel 32 and the stator 36 can be performed in accordance with the principle of a hydraulic oscillating motor and thus the phase angle between the inner shaft 16 and the outer shaft 18 can be adjusted.

The invention is not limited to the embodiment described above. In view of the technical knowledge of a skilled person, a person of skill in the art can create different embodiments that remain within the scope of the claims.

LIST OF REFERENCE CHARACTERS

10 camshaft drive according to the invention
12 drive shaft
14 shaft-in-shaft system
15 housing
16 inner shaft
18 outer shaft
20 exhaust cams
22 intake cams
24 drive element
26 drive gearwheel
28 intermediate member
30 central screw
32 vane wheel
33 rotor
34 stator drive element
36 stator
38 stator housing
40 stator cover
42 outer shaft transmission element
44 outer shaft gearwheel
46 oil boreholes
48 oil distribution groove
50 chamber
52 channels

What is claimed is:

1. A camshaft drive for an internal combustion engine having valves, the camshaft drive comprising:

a) a drive shaft having at least one cam for actuating one of the valves of the internal combustion engine;

b) a shaft-in-shaft system disposed parallel to said drive shaft, said shaft-in-shaft system having an inner shaft and an outer shaft, said outer shaft being disposed coaxial to said inner shaft and surrounding said inner shaft;

c) said inner shaft and said outer shaft each having at least one cam for actuating one of the valves of the internal combustion engine;

d) an outer shaft transmission element, said outer shaft being coupled to said drive shaft via said outer shaft transmission element, said outer shaft being connected to said outer shaft transmission element in a manner fixed against relative rotation;

e) a hydraulic transmission device including a stator, a rotor, and an intermediate member disposed between said rotor and said inner shaft, said inner shaft being coupled to said drive shaft via said hydraulic transmission device;

f) an adjusting device and a control device, said hydraulic transmission device being operatively connected to said adjusting device and to said control device for setting a desired phase angle between said inner shaft and said outer shaft, said control device including at least one device selected from the group consisting of an open loop control device and a closed loop control device; and g) a drive element coupled to said drive shaft, said drive element being directly coupled both to said outer shaft transmission element and to said stator, wherein said outer shaft transmission element is an outer shaft gearwheel, said drive element is a drive gearwheel, said outer shaft gearwheel meshes with said drive gearwheel, and said stator has an outer toothing which also meshes with said drive gearwheel.

2. The camshaft drive according to claim 1, wherein:

said outer shaft gearwheel and said stator each have a respective outer diameter, the outer diameter of said outer shaft gearwheel being equal to the outer diameter of said stator; and said outer shaft gearwheel has a toothing that is the same as said outer toothing of said stator.

3. The camshaft drive according to claim 1, wherein said outer shaft gearwheel directly adjoins said outer toothing of said stator.

4. The camshaft drive according to claim 1, wherein:

a first plurality of the valves of the internal combustion engine are exhaust valves and a second plurality of the valves of the internal combustion engine are intake valves;

said at least one cam of said drive shaft is a first plurality of cams provided for controlling the exhaust valves; and said at least one cam of said outer shaft and said at least one cam of said inner shaft are a second plurality of cams provided for controlling the intake valves.

5. The camshaft drive according to claim 1, wherein said stator is formed of several individual elements.

6. The camshaft drive according to claim 1, wherein:

said inner shaft is a hollow shaft and said intermediate member is a central screw;

said central screw has at least one fluid channel; and said rotor and said stator form a chamber, said at least one fluid channel leads from said hollow shaft to said chamber formed by said rotor and said stator, wherein said hollow shaft and said central screw together with said rotor and said stator form a hydraulic oscillating motor.

7. The camshaft drive according to claim 6, wherein said inner shaft and said outer shaft have channels for introducing pressure oil from outside into said inner shaft.

* * * * *